US006538379B2

(12) United States Patent
Taniguchi et al.

(10) Patent No.: US 6,538,379 B2
(45) Date of Patent: Mar. 25, 2003

(54) DISCHARGE LAMP

(75) Inventors: Shinji Taniguchi, Kyoto (JP); Yasaburo Takeji, Kyoto (JP); Kuniaki Nakano, Kyoto (JP); Jiro Honda, Kyoto (JP); Shigeyuki Mori, Kyoto (JP)

(73) Assignee: Japan Storage Battery Co., Ltd., Kyoto (JP)

( * ) Notice: Subject to any disclaimer, the term of this patent is extended or adjusted under 35 U.S.C. 154(b) by 63 days.

(21) Appl. No.: 09/866,834

(22) Filed: May 30, 2001

(65) Prior Publication Data

US 2002/0003404 A1 Jan. 10, 2002

(30) Foreign Application Priority Data

May 30, 2000 (JP) ..... 2000-160761
Jun. 1, 2000 (JP) ..... 2000-164521
May 22, 2001 (JP) ..... 2001-152513

(51) Int. Cl.[7] ..... H01J 61/00
(52) U.S. Cl. ..... 313/573; 313/634; 313/638
(58) Field of Search ..... 313/573, 634, 313/571, 638

(56) References Cited

U.S. PATENT DOCUMENTS 5,994,839 A 11/1999 Yamamoto et al.
6,137,229 A * 10/2000 Nishiura et al. ..... 313/573 X
6,307,321 B1 * 10/2001 Honda et al. ..... 313/634
6,362,569 B1 * 3/2002 Wijenberg et al. ..... 313/634

FOREIGN PATENT DOCUMENTS

| | | |
|---|---|---|
| EP | 0887841 A2 | 12/1998 |
| EP | 0926703 A2 | 6/1999 |
| EP | 0954007 A1 | 11/1999 |
| EP | 1058288 A1 | 12/2000 |

* cited by examiner

*Primary Examiner*—Ashok Patel
(74) *Attorney, Agent, or Firm*—Sughure Mion, PLLC

(57) ABSTRACT

A discharge lamp comprises an arc tube 6 made of a translucent ceramic dosed with a metallic halide. The discharge is conducted between electrodes 20 disposed in the arc tube 6. The arc tube 6 comprises a main tube body 11 having a large diameter portion 11A and a small diameter portion 11C, and a narrow tube 12 airtightly fixed to the small diameter portion 11C while penetrating the small diameter portion 11C. In the discharge lamp, supposing that L (mm) is the length of a protrusion from the main tube body of the narrow tube portion 12 and P (W) is the rated power of the discharge lamp, L and P satisfy the relationship $(P+268.75)/31.25 \leqq L \leqq (P+456.25)/31.25$ and $200 \leqq P \leqq 450$.

3 Claims, 2 Drawing Sheets

DISCHARGE LAMP

BACKGROUND OF THE INVENTION

1. Field of the Invention

The present invention relates to a discharge lamp comprising a translucent ceramic tube body dosed with a metallic halide. More particularly, the present invention relates to a discharge lamp having an enhanced output.

2. Description of the Related Art

The arc tube of this type of a discharge lamp comprises a narrow tube portion at both ends thereof. The narrow tube portion is formed by tapering the both ends of a tube body made of a translucent ceramic such as polycrystalline alumina. An electricity-introducing member connected to electrodes is inserted in the narrow tube portion and sealed with a sealing glass.

The reason why a narrow tube portion is formed at both ends is that the thermal capacity of the arc tube is reduced to enhance the lamp efficiency. Another reason is that the size of the sealed portion is reduced to enhance the reliability of airtightness.

However, it has been extremely difficult for this type of a discharge lamp to raise the output of its arc tube to a value as high as rated power of 200 W or more. The reason for this difficulty will be as follows.

In order to enhance the lamp efficiency, the thermal capacity of the arc tube must be reduced. To this end, the length of the narrow tube portion must decrease to reduce the thermal capacity.

However, as the length of the narrow tube portion decreases, the central part of the arc tube, the temperature of which has been raised due to the enhancement of output, and the sealed portion are close to each other, making the temperature of the sealed portion considerably high. This can easily cause the reaction of the sealing glass of the sealed portion with a metallic halide as an enclosure. This also causes the increase of thermal stress developed on the various members constituting the sealed portion, causing the production of a gap between the electricity-introducing member and the sealing glass. Accordingly, as the length of the narrow tube portion decreases, the sealed portion is subject to loss of airtightness leading to gas leak.

On the contrary, of course, as the length of the narrow tube portion increases, the temperature of the sealed portion lowers, making it possible to sufficiently maintain its airtightness. However, the resulting increase of thermal capacity of the arc tube causes the drop of lamp efficiency.

SUMMARY OF THE INVENTION

It is therefore an object of the invention to provide a discharge lamp including a translucent alumina tube and having an output of from 200 W to 450 W, which has the enhanced reliability of airtightness of a sealed portion therein while the lamp efficiency thereof is increased.

It was found in the invention that when L and P satisfy the relationship $(P+268.75)/31.25 \leqq L \leqq (P+456.25)/31.25$ and $200\ W \leqq P \leqq 450\ W$, the reliability of airtightness of the sealed portion can be enhanced while the lamp efficiency is increased. Here, L (mm) is the length of a protrusion from a main tube body of a narrow tube of the discharge lamp and P (W) is the rated power of the discharge lamp.

When the foregoing relationship is satisfied, a central portion of the main tube body, the temperature of which rises during lighting of the lamp, and the sealed portion can be sufficiently separated from each other. Further, even during lighting of the lamp, the temperature of the sealed portion can be kept low. Accordingly, the reaction of the sealing glass of the sealed portion with the enclosure and the development of thermal stress on the various members constituting the sealed portion can be suppressed to enhance the airtightness of the sealed portion, making it possible to prevent leakage.

Further, when the foregoing relationship is satisfied, the rise of thermal capacity can be suppressed to an extent such that the lamp efficiency cannot be lowered.

In the above-mentioned discharge lamp, it is preferable that the temperature of the sealed portion during lighting of the lamp is not higher than 680° C.

DETAILED DESCRIPTION OF THE INVENTION

Figure 1:
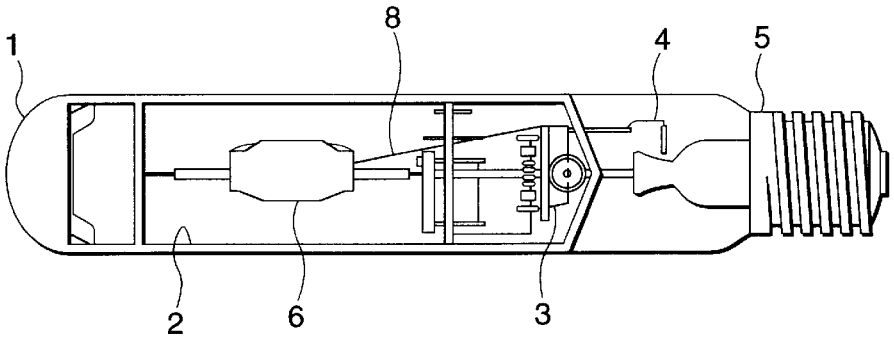
FIG. 1 is a schematic sectional view illustrating an embodiment of a discharge lamp according to the invention.

FIG. 1 indicates an embodiment of a discharge lamp according to the invention. This discharge lamp comprises an arc tube 6 supported in a glass outer bulb 1 with a supporting frame 2 made of metallic rod. In the outer bulb 1 are enclosed a starter 3, a getter 4, and a metallic ignition aid 8. The starter 3 generates a pulse voltage in the outer bulb 1. The metallic ignition aid 8 comprises a metallic wire provided along the arc tube 6 for facilitating starting. At the end of the outer bulb 1 is provided a cap 5.

Figure 2:
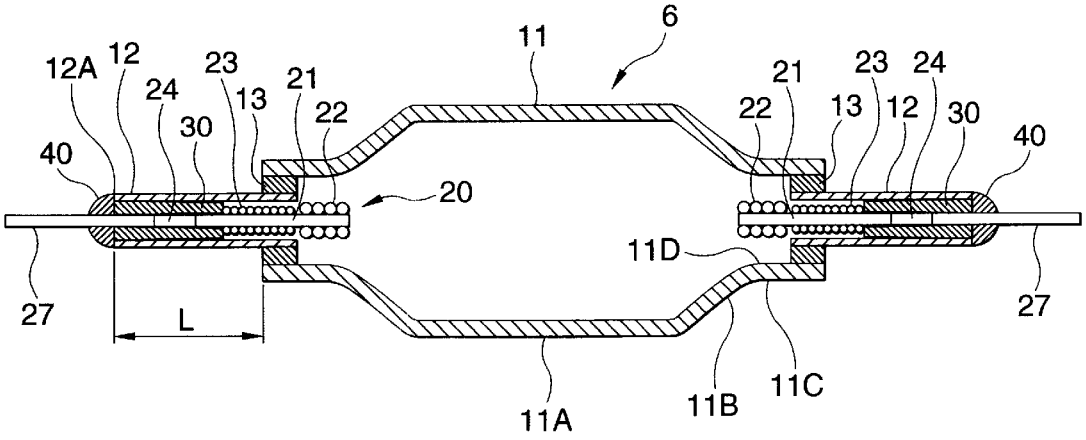
FIG. 2 is a sectional view of an arc tube.

A detailed structure of the arc tube 6 is shown in FIG. 2. The arc tube 6 comprises a main tube body 11 made of translucent alumina, narrow tubes 12, and end plates 13 made of translucent alumina. The narrow tubes 12 are attached to both ends of the main tube body 11 with the interposition of the end plate 13 respectively. The main tube body 11 integrally comprises a truly cylindrical large diameter portion 11A, tapered cylindrical portions 11B and truly cylindrical small diameter portions 11C. The large diameter portion 11A extends in the longitudinal direction of the main tube body 11 with a predetermined length and has an inner and outer diameter greater than that of the other portions. The tapered cylindrical portions 11B extend from the both sides of the large diameter portion 11A respectively and each of the tapered cylindrical portions 11B has a diameter gradually decreasing toward the end thereof. Each of the small diameter portions 11C extends from the end of the tapered portion 11B with a predetermined length. The main tube body 11 is formed by molding, e.g., alumina clay through an extruder into a truly cylindrical shape and cutting the molded material to a predetermined size, receiving the cut material in a mold and blowing compressed air into the material so that it is expanded at the middle portion thereof, so as to obtain the molded material having a desired shape, and then calcining the molded material.

Figure 3:
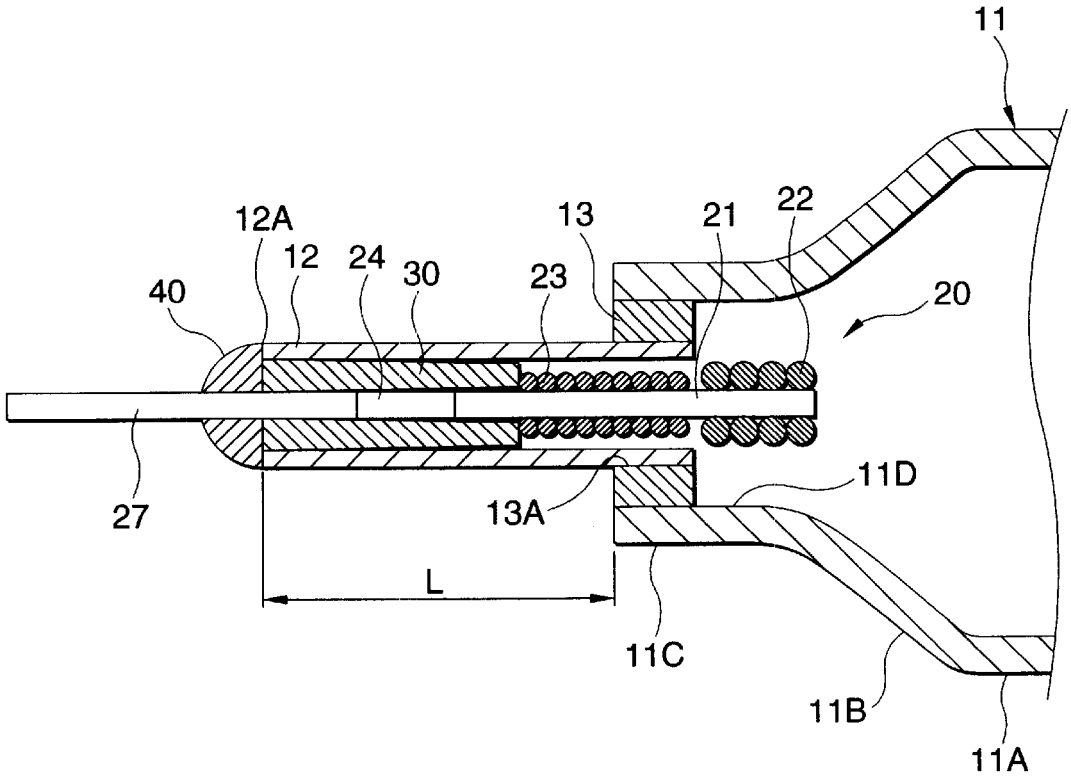
FIG. 3 is an enlarged sectional view of a narrow tube.

The end plate 13 is in the form of disk. The end plate 13 is fitted and airtightly fixed to the inner face of the outer end face of the small diameter portion 11C of the main tube portion 11 by being integrally sintered to the small diameter portion 11C. The thickness of the end plate 13 is from 2 mm to 3 mm, which is smaller than the length of the small diameter portion 11C. Thus, a linear cylindrical portion 11D is formed deep inside the small diameter portion 11C as shown in FIG. 3. At the center of the end plate 13 is formed a penetrating hole 13A to which the narrow tube 12 made of alumina is fixed while penetrating the hole 13A. Inside the narrow tube 12 are airtightly fixed electricity-introducing members 24 and 27 connected to an electrode 20 and a ceramic sleeve 30 made of translucent ceramic with a sealing glass 40. The narrow tube 12 protrudes from the main tube body 11. Supposing that L (mm) is the length of a protrusion from the main tube body 11 of the narrow tube 12 and P (W) is the rated power of the discharge lamp, L and P satisfy the relationship $(P+268.75)/31.25 \leqq L \leqq (P+456.25)/31.25$ and the rated lamp power P is from not lower than 200 W to not higher than 450 W ($200\ W \leqq P \leqq 450\ W$). By determining the protrusion length L such that these relationships are satisfied, even a high-pressure vapor discharge lamp having a power of from not lower than 200 W to not higher than 450 W can provide sufficient light-emitting properties while being prevented from leaking the gas enclosed in the arc tube 6.

The electrode 20 is formed by winding a first coil 22 on the forward end of an electrode core 21 while winding a second coil 23 on the base end of the electrode core 21 such that the first coil 22 protrudes into the interior of the main tube body 11 from the narrow tube 12. Rod-shaped electricity-introducing members 24 and 27 are sequentially butt-welded to the base end of the core 21 of the electrode 20. The electricity-introducing member 27 leads out of the narrow tube 12. The purpose of the first coil 22 is to protect the electrode 20 against the high temperature of arc spot formed at the forward end of the electrode during lighting of the lamp. The purpose of the second coil 23 is to allow the heat at the forward end of the electrode to escape toward the rear part of the electrode. The another purpose of the second coil 23 is to position the ceramic sleeve 30.

By using the end plate 13 together with the main tube body 11 of the arc tube 6 as mentioned above, the desired discharge lamp can be easily prepared, making it possible to drastically reduce the cost.

EXAMPLES 1 TO 4; COMPARATIVE EXAMPLES 1 TO 7

A discharge lamp comprising a arc tube 6 with the structure shown in FIGS. 2 and 3 will be described hereinafter. Discharge lamps having a rated power of 200 W and an electrode protrusion length L of from 11 to 31 mm (Examples 1 to 4; Comparative Examples 1 to 7) were prepared. The electricity-introducing member 24 was made of molybdenum. The electricity-introducing member 27 was made of niobium wire. The ceramic sleeve 30 was made of alumina. The sealing glass 40 was made of $Al_2O_3$—$SiO_2$—$Dy_2O_3$. The arc tube 6 was dosed with mercury, dysprosium iodide, thallium iodide, sodium iodide, cesium iodide, and argon gas as a starting gas.

The arc tube 6 thus structured was then incorporated in a vacuum outer bulb 1 to complete a discharge lamp. The discharge lamp was then subjected to gas leak test at the sealing glass 40. The test results are set forth in Table 1. In Table 1, the lamp efficiency indicates the value measured after 100 hours of aging of the discharge lamp thus completed. The gas leak indicates the results determined after 7,000 hours of lighting. For the criterion of evaluation, ○ indicates that no gas leak occurs and the lamp efficiency is not lower than 88 (1 m/W), and X indicates the other discharge lamps.

The discharge lamp having a protrusion length L of 11 mm exhibited a lamp efficiency as high as 90 (1 m/W) but showed gas leakage after about 1,000 hours of lighting and thereby stopped lighting. The discharge lamp having a protrusion length L of 13 mm exhibited a lamp efficiency as high as 90 (1 m/W) but showed gas leakage after about 3,800 hours of lighting and thereby stopped lighting. The discharge lamps having a protrusion length L of not smaller than 23 mm exhibited a lamp efficiency as low as 85 (1 m/W). This is presumably because the increase of the protrusion length L causes the increase of the thermal capacity of the arc tube 6 and hence the increase of thermal loss. On the contrary, the discharge lamps having a protrusion length L of from 15 to 21 mm were found to have a high lamp efficiency and show no gas leak.

TABLE 1

| | Protrusion length (mm) | Lamp efficiency (lm/W) | Gas leak | Evaluation |
|---|---|---|---|---|
| Example 1 | 15 | 89 | No leak | ○ |
| Example 2 | 17 | 89 | No leak | ○ |
| Example 3 | 19 | 89 | No leak | ○ |
| Example 4 | 21 | 88 | No leak | ○ |
| Comparative Example 1 | 11 | 90 | Leak | X |
| Comparative Example 2 | 13 | 90 | Leak | X |
| Comparative Example 3 | 23 | 85 | No leak | X |
| Comparative Example 4 | 25 | 84 | No leak | X |
| Comparative Example 5 | 27 | 82 | No leak | X |
| Comparative Example 6 | 29 | 82 | No leak | X |
| Comparative Example 7 | 31 | 80 | No leak | X |

Further, the various discharge lamps were each measured for the temperature of the sealed portion of the narrow tube 12. The term "sealed portion" as used herein is meant to indicate the portion of the narrow tube 12 close to the main tube body 11 about 1.5 mm from the end 12A thereof. For the measurement of the temperature of the sealed portion, the temperature of the outer surface of the sealed portion was measured using a radiation thermometer. A black body coating having a known emissivity was coated on the point to be measured. The discharge lamps having a protrusion length L of 11 mm, 13 mm, 15 mm and 17 mm showed a temperature of 735° C., 700° C., 680° C. and 670° C., respectively, at the sealed portion. This result leads to the discharge lamp in which the temperature of the sealed portion of the narrow tube during lighting of the discharge lamp is not higher than 680° C. has a high lamp efficiency and shows no gas leak.

EXAMPLES 5 TO 8; COMPARATIVE EXAMPLES 8 TO 13

Discharge lamps having a rated power of 450 W were subjected to test in the same manner as in Examples 1 to 4. In this test, discharge lamps having an electrode protrusion length L of from 13 to 31 mm (Examples 5 to 8; Comparative Examples 8 to 13) were used. In the table, the lamp efficiency indicates the value measured after 100 hours of aging of the discharge lamp. The gas leak indicates the results determined after 7,000 hours of lighting. For the criterion of evaluation, ○ indicates that no gas leak occurs and the lamp efficiency is not lower than 91 (1 m/W), and X indicates the other discharge lamps. The results are set forth in Table 2.

TABLE 2

| | Protrusion length (mm) | Lamp efficiency (lm/W) | Gas leak | Evaluation |
|---|---|---|---|---|
| Example 5 | 23 | 93 | No leak | ○ |
| Example 6 | 25 | 93 | No leak | ○ |
| Example 7 | 27 | 93 | No leak | ○ |
| Example 8 | 29 | 93 | No leak | ○ |
| Comparative Example 8 | 13 | 94 | Leak | X |
| Comparative Example 9 | 15 | 94 | Leak | X |
| Comparative Example 10 | 17 | 94 | Leak | X |
| Comparative Example 11 | 19 | 94 | Leak | X |
| Comparative Example 12 | 21 | 94 | Leak | X |
| Comparative Example 13 | 31 | 90 | No leak | X |

The discharge lamps having a protrusion length L of not greater than 19 mm exhibited a high lamp efficiency but showed gas leakage after about 1,000 hours of lighting and thereby stopped lighting. The discharge lamp having a protrusion length L of 21 mm showed gas leak after about 5,000 hours of lighting. The discharge lamp having a protrusion length L of 31 mm exhibited a lamp efficiency as low as 90 (1 m/W) and thus was not suitable for practical use. On the contrary, the discharge lamps having a protrusion length L of from 23 to 29 mm were found to exhibit a high lamp efficiency and show no gas leak. Further, the various discharge lamps were each measured for the temperature of the sealed portion of the narrow tube 12 in the same manner as in Examples 1 to 4 and Comparative Examples 1 to 7. The discharge lamps having a protrusion length L of 21 mm and 23 mm showed a temperature of 690° C. and 675° C., respectively, at the sealed portion. This result leads to the discharge lamp in which the temperature of the sealed portion of the narrow tube during lighting of the discharge lamp is 675° C. has a high lamp efficiency and shows no gas leak.

The above-mentioned results lead to a proper protrusion length L at a rated lamp power of 200 W and 450 W. It was also found that as the rated lamp power increases, the proper protrusion length L increases. Referring to the reason for this mechanism, as the rated lamp power increases, the amount of heated generated by the arc tube increases, making it impossible to prevent gas leak unless the protrusion length L increases.

EXAMPLES 9 TO 12; COMPARATIVE EXAMPLES 14 TO 20

Figure 4:
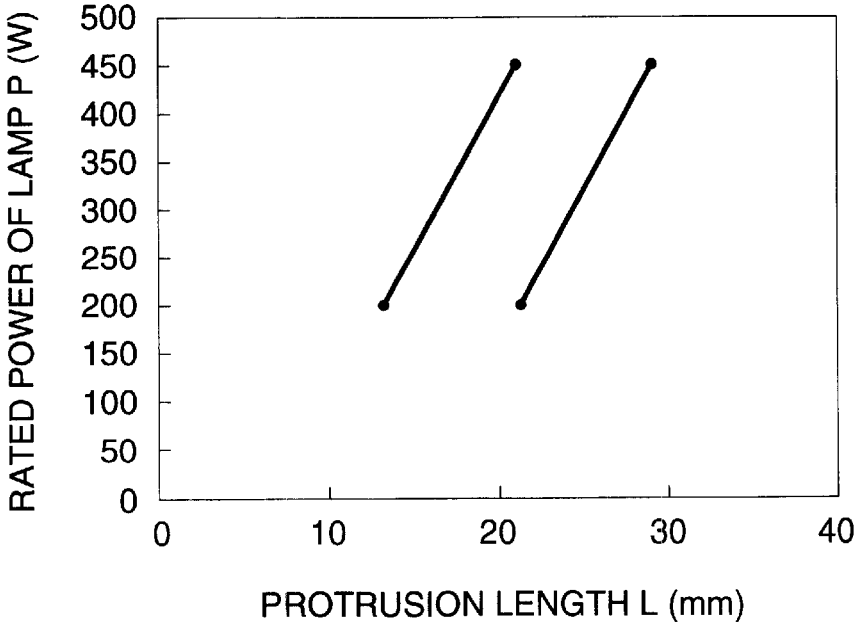
FIG. 4 is a graph illustrating the relationship between the length of the protrusion from the narrow tube and the rated lamp power.

From the results of discharge lamps having a power of 200 W and 450 W, FIG. 4 was prepared to determine the proper protrusion length L for discharge lamps having a rated lamp power other than 200 W and 450 W.

In some detail, with the protrusion length L (mm) as abscissa and the rated lamp power P (W) as ordinate, the minimum value and maximum value of the proper protrusion length L for rated lamp power of 200 W were plotted. A straight line was drawn between the two points. Similarly, the minimum value and maximum value of the proper protrusion length L for rated lamp power of 450 W were plotted. A straight line was drawn between the two points. A straight line was drawn between the point of the minimum value of the protrusion length L for rated lamp power of 200 W and the point of the minimum value of the protrusion length L for rated lamp power of 450 W. A straight line was drawn between the point of the maximum value of the protrusion length L for rated lamp power of 200 W and the point of the maximum value of the protrusion length L for rated lamp power of 450 W. As a result, a rectangle was formed. It is thought that discharge lamps having a rated power other than 200 W and 450 W exhibit a high lamp efficiency and show no gas leak when the protrusion length L falls within this range. It is also thought that when the temperature of the sealed portion is not higher than 680° C., no gas leak occurs.

In order to confirm substantiate the presumption, the following experiment was conducted. In some detail, 300 W discharge lamps (Examples 9 to 12; Comparative Examples 14 to 20) were prepared as examples of the discharge lamp having a rated power falling within this range. These discharge lamps had a protrusion length L of from 13 to 31 mm. Subsequently, these discharge lamps were subjected to test in the same manner as in Examples 1 to 4 and Comparative Examples 1 to 7. For the criterion of evaluation, ○ indicates that no gas leak occurs and the lamp efficiency is not lower than 90 (1 m/W), and X indicates the other discharge lamps. The results are set forth in Table 3.

TABLE 3

| | Protrusion length (mm) | Lamp efficiency (lm/W) | Gas leak | Evaluation |
|---|---|---|---|---|
| Example 9 | 19 | 92 | No leak | ○ |
| Example 10 | 21 | 92 | No leak | ○ |
| Example 11 | 23 | 91 | No leak | ○ |
| Example 12 | 24 | 90 | No leak | ○ |
| Comparative Example 14 | 13 | 93 | Leak | X |
| Comparative Example 15 | 15 | 92 | Leak | X |
| Comparative Example 16 | 17 | 92 | Leak | X |
| Comparative Example 17 | 25 | 89 | No leak | X |
| Comparative Example 18 | 27 | 89 | No leak | X |
| Comparative Example 19 | 29 | 87 | No leak | X |
| Comparative Example 20 | 31 | 85 | No leak | X |

It was found that the discharge lamps having a protrusion length L of from 19 to 24 mm exhibit a high lamp efficiency and show no gas leak. It was also found that the discharge lamps having a protrusion length L of 17 mm and 19 mm showed a temperature of 690° C. and 670° C., respectively, at the sealed portion.

Further, it was found that when the minimum value (19 mm, 300 W) and the maximum value (24 mm, 300 W) of the proper protrusion length L are plotted in FIG. 4, they lie within the rectangle and on the rectangular frame. Accordingly, it was found that discharge lamps having a rated power of from not lower than 200 W to not higher than 450 W exhibit a high lamp efficiency and show no gas leak when designed such that the electrode protrusion length L lies in the rectangle shown in FIG. 4. The range falling within the rectangle shown in FIG. 4 can be represented by the equations $200 \leqq Y \leqq 450$ and $(Y+268.75)/31.25 \leqq X \leqq (Y+$ 456.25)/31.25. Supposing that the rated lamp power is P (W) and the protrusion length of the narrow tube is L (mm), it can be represented by the equations $200 \leqq P \leqq 450$ and $(P+268.75)/31.25 \leqq L \leqq (P+456.25)/31.25$. Accordingly, discharge lamps designed such that these relationships are satisfied exhibit a high lamp efficiency and show no gas leak.

When the electrode protrusion length L is as great as possible within the rectangular range shown in FIG. 4 to approach the straight line ($31.25 \times L - 456.25 = P$), the temperature of the glass-sealed portion is lower. These discharge lamps can be prevented from leaking gas for a long period of time.

Further, when the electrode protrusion length L is designed such that the temperature of the sealed portion during lighting of lamp is not higher than 680° C., a discharge lamp which shows no gas leak can be obtained.

What is claimed is:

1. A discharge lamp comprising:

an arc tube made of a translucent ceramic and dosed with a metallic halide, said arc tube including:

a main tube body having a large diameter portion and small diameter portions each disposed at both sides of the large diameter portion; and a narrow tube having a smaller diameter than that of the small diameter portion and airtightly fixed to the small diameter portion while penetrating the small diameter portion;

a pair of electrodes disposed in said arc tube such that discharge is conducted between said electrodes;

wherein a relationship $(P+268.75)/31.25 \leqq L \leqq (P+456.25)/31.25$ and $200 \leqq P \leqq 400$ is satisfied where P (W) is the rated power of the discharge lamp and L (mm) is a length of a protrusion of the narrow tube which is protruded form said main tube body.

2. The discharge lamp according to claim 1, wherein said narrow tube is sealed with a sealing member at an end thereof wherein a temperature of said narrow tube at a position adjacent to the end thereof during lighting of said discharge lamp is not higher than 680° C.

3. The discharge lamp according to claim 2, wherein the position is located apart from the end of the narrow tube by about 1.5 mm.

* * * * *